US006505921B2

(12) United States Patent
Chwalek et al.

(10) Patent No.: US 6,505,921 B2
(45) **Date of Patent: *Jan. 14, 2003**

(54) INK JET APPARATUS HAVING AMPLIFIED ASYMMETRIC HEATING DROP DEFLECTION

(75) Inventors: James M. Chwalek, Pittsford, NY (US); Christopher N. Delametter, Rochester, NY (US); David L. Jeanmaire, Brockport, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/751,563

(22) Filed: Dec. 28, 2000

(65) Prior Publication Data

US 2002/0085073 A1 Jul. 4, 2002

(51) Int. Cl.[7] ..... B41J 2/02; B41J 2/09; B41J 2/105

(52) U.S. Cl. ..... 347/77; 347/82

(58) Field of Search ..... 347/74, 75, 76, 347/77, 78, 82

(56) References Cited

U.S. PATENT DOCUMENTS

| | | | | |
|---|---|---|---|---|
| 1,941,001 A | | 12/1933 | Hansell | |
| 3,373,437 A | | 3/1968 | Sweet et al. | |
| 3,416,153 A | | 12/1968 | Hertz et al. | |
| 3,709,432 A | | 1/1973 | Robertson | |
| 3,878,519 A | | 4/1975 | Eaton | |
| 4,068,241 A | * | 1/1978 | Yamada | 347/82 |
| 4,190,844 A | | 2/1980 | Taylor | |
| 4,337,470 A | * | 6/1982 | Furukawa | 347/74 |
| 4,346,387 A | | 8/1982 | Hertz | |
| 4,395,716 A | | 7/1983 | Crean et al. | |
| 4,914,522 A | | 4/1990 | Duffield et al. | |
| 5,224,843 A | | 7/1993 | vanLintel | |
| 6,079,821 A | | 6/2000 | Chwalek et al. | |

FOREIGN PATENT DOCUMENTS

| | | | | |
|---|---|---|---|---|
| WO | WO 81/03149 | * | 11/1981 | 347/77 |

* cited by examiner

*Primary Examiner*—Huan Tran
(74) *Attorney, Agent, or Firm*—William R. Zimmerli

(57) ABSTRACT

Apparatus for controlling ink in a continuous ink jet printer includes an ink delivery channel; a source of pressurized ink communicating with the ink delivery channel; a nozzle bore which opens into the ink delivery channel to establish a continuous flow of ink in a stream, the nozzle bore defining a nozzle bore perimeter; a drop generator which causes the stream to break up into a plurality of drops at a position spaced from the ink stream generator; and a drop deflector. The drop generator includes a heater having a selectively-actuated section associated with only a portion of the nozzle bore perimeter, whereby actuation of the heater section produces an asymmetric application of heat to the stream to partially control the direction of the stream. The drop deflector includes a gas flow source producing an additional control to the stream between a print direction and a non-print direction.

16 Claims, 6 Drawing Sheets

INK JET APPARATUS HAVING AMPLIFIED ASYMMETRIC HEATING DROP DEFLECTION

FIELD OF THE INVENTION

This invention relates generally to the field of digitally controlled printing devices, and in particular to continuous ink jet printers in which a liquid ink stream breaks into drops, some of which are selectively deflected.

BACKGROUND OF THE INVENTION

Traditionally, digitally controlled color printing capability is accomplished by one of two technologies. In each technology, ink is fed through channels formed in a printhead. Each channel includes a nozzle from which drops of ink are selectively extruded and deposited upon a medium. When color printing is desired, each technology typically requires independent ink supplies and separate ink delivery systems for each ink color used during printing.

The first technology, commonly referred to as "drop-on-demand" ink jet printing, provides ink drops for impact upon a recording surface using a pressurization actuator (thermal, piezoelectric, etc.). Selective activation of the actuator causes the formation and ejection of a flying ink drop that crosses the space between the printhead and the print media and strikes the print media. The formation of printed images is achieved by controlling the individual formation of ink drops, as is required to create the desired image. Typically, a slight negative pressure within each channel keeps the ink from inadvertently escaping through the nozzle, and also forms a slightly concave meniscus at the nozzle, thus helping to keep the nozzle clean.

Conventional "drop-on-demand" ink jet printers utilize a pressurization actuator to produce the ink jet drop at orifices of a print head. Typically, one of two types of actuators are used including heat actuators and piezoelectric actuators. With heat actuators, a heater, placed at a convenient location, heats the ink causing a quantity of ink to phase change into a gaseous steam bubble that raises the internal ink pressure sufficiently for an ink drop to be expelled. With piezoelectric actuators, an electric field is applied to a piezoelectric material possessing properties that create a mechanical stress in the material causing an ink drop to be expelled. The most commonly produced piezoelectric materials are ceramics, such as lead zirconate titanate, barium titanate, lead titanate, and lead metaniobate.

U.S. Pat. No. 4,914,522 issued to Duffield et al., on Apr. 3, 1990 discloses a drop-on-demand ink jet printer that utilizes air pressure to produce a desired color density in a printed image. Ink in a reservoir travels through a conduit and forms a meniscus at an end of an inkjet nozzle. An air nozzle, positioned so that a stream of air flows across the meniscus at the end of the ink nozzle, causes the ink to be extracted from the nozzle and atomized into a fine spray. The stream of air is applied at a constant pressure through a conduit to a control valve. The valve is opened and closed by the action of a piezoelectric actuator. When a voltage is applied to the valve, the valve opens to permit air to flow through the air nozzle. When the voltage is removed, the valve closes and no air flows through the air nozzle. As such, the ink dot size on the image remains constant while the desired color density of the ink dot is varied depending on the pulse width of the air stream.

The second technology, commonly referred to as "continuous stream" or "continuous" ink jet printing, uses a pressurized ink source which produces a continuous stream of ink drops. Conventional continuous ink jet printers utilize electrostatic charging devices that are placed close to the point where a filament of working fluid breaks into individual ink drops. The ink drops are electrically charged and then directed to an appropriate location by deflection electrodes having a large potential difference. When no print is desired, the ink drops are deflected into an ink capturing mechanism (catcher, interceptor, gutter, etc.) and either recycled or disposed of. When print is desired, the ink drops are not deflected and allowed to strike a print media. Alternatively, deflected ink drops may be allowed to strike the print media, while non-deflected ink drops are collected in the ink capturing mechanism.

U.S. Pat. No. 3,878,519, issued to Eaton, on Apr. 15, 1975, discloses a method and apparatus for synchronizing drop formation in a liquid stream using electrostatic deflection by a charging tunnel and deflection plates.

U.S. Pat. No. 4,346,387, issued to Hertz, on Aug. 24, 1982, discloses a method and apparatus for controlling the electric charge on drops formed by the breaking up of a pressurized liquid stream at a drop formation point located within the electric field having an electric potential gradient. Drop formation is effected at a point in the field corresponding to the desired predetermined charge to be placed on the drops at the point of their formation. In addition to charging tunnels, deflection plates are used to actually deflect drops.

U.S. Pat No. 4,638,382, issued to Drake et al., on Jan. 20, 1987, discloses a continuous ink jet printhead that utilizes constant thermal pulses to agitate ink streams admitted through a plurality of nozzles in order to break up the ink streams into drops at a fixed distance from the nozzles. At this point, the drops are individually charged by a charging electrode and then deflected using deflection plates positioned the drop path.

As conventional continuous ink jet printers utilize electrostatic charging devices and deflector plates, they require many components and large spatial volumes in which to operate. This results in continuous ink jet printheads and printers that are complicated, have high energy requirements, are difficult to manufacture, and are difficult to control.

U.S. Pat. No. 3,709,432, issued to Robertson, on Jan. 9, 1973, discloses a method and apparatus for stimulating a filament of working fluid causing the working fluid to break up into uniformly spaced ink drops through the use of transducers. The lengths of the filaments before they break up into ink drops are regulated by controlling the stimulation energy supplied to the transducers, with high amplitude stimulation resulting in short filaments and low amplitudes resulting in long filaments. A flow of air is generated across the paths of the fluid at a point intermediate to the ends of the long and short filaments. The air flow affects the trajectories of the filaments before they break up into drops more than it affects the trajectories of the ink drops themselves. By controlling the lengths of the filaments, the trajectories of the ink drops can be controlled, or switched from one path to another. As such, some ink drops may be directed into a catcher while allowing other ink drops to be applied to a receiving member.

While this method does not rely on electrostatic means to affect the trajectory of drops it does rely on the precise control of the break off points of the filaments and the placement of the air flow intermediate to these break off points. Such a system is difficult to control and to manufacture. Furthermore, the physical separation or amount of discrimination between the two drop paths is small further adding to the difficulty of control and manufacture.

U.S. Pat. No. 4,190,844, issued to Taylor, on Feb. 26, 1980, discloses a continuous ink jet printer having a first pneumatic deflector for deflecting non-printed ink drops to a catcher and a second pneumatic deflector for oscillating printed ink drops. A printhead supplies a filament of working fluid that breaks into individual ink drops. The ink drops are then selectively deflected by a first pneumatic deflector, a second pneumatic deflector, or both. The first pneumatic deflector is an "on/off" or an "open/closed" type having a diaphram that either opens or closes a nozzle depending on one of two distinct electrical signals received from a central control unit. This determines whether the ink drop is to be printed or non-printed. The second pneumatic deflector is a continuous type having a diaphram that varies the amount a nozzle is open depending on a varying electrical signal received the central control unit. This oscillates printed ink drops so that characters may be printed one character at a time. If only the first pneumatic deflector is used, characters are created one line at a time, being built up by repeated traverses of the printhead.

While this method does not rely on electrostatic means to affect the trajectory of drops it does rely on the precise control and timing of the first ("open/closed") pneumatic deflector to create printed and non-printed ink drops. Such a system is difficult to manufacture and accurately control resulting in at least the ink drop build up discussed above. Furthermore, the physical separation or amount of discrimination between the two drop paths is erratic due to the precise timing requirements increasing the difficulty of controlling printed and non-printed ink drops resulting in poor ink drop trajectory control.

Additionally, using two pneumatic deflectors complicates construction of the printhead and requires more components. The additional components and complicated structure require large spatial volumes between the printhead and the media, increasing the ink drop trajectory distance. Increasing the distance of the drop trajectory decreases drop placement accuracy and affects the print image quality. Again, there is a need to minimize the distance the drop must travel before striking the print media in order to insure high quality images. Pneumatic operation requiring the air flows to be turned on and off is necessarily slow in that an inordinate amount of time is needed to perform the mechanical actuation as well as time associated with the settling any transients in the air flow.

U.S. Pat. No. 6,079,821, issued to Chwalek et al., on Jun. 27, 2000, discloses a continuous ink jet printer that uses actuation of asymmetric heaters to create individual ink drops from a filament of working fluid and deflect those ink drops. A printhead includes a pressurized ink source and an asymmetric heater operable to form printed ink drops and non-printed ink drops. Printed ink drops flow along a printed ink drop path ultimately striking a print media, while non-printed ink drops flow along a non-printed ink drop path ultimately striking a catcher surface. Non-printed ink drops are recycled or disposed of through an ink removal channel formed in the catcher.

While the ink jet printer disclosed in Chwalek et al. works extremely well for its intended purpose, the amount of physical separation between printed and non-printed ink drops is limited which may limit the robustness of such a system. Simply increasing the amount of asymmetric heating to increase this separation will result in higher temperatures that may decrease reliability.

It can be seen that there is a need to provide an ink jet printhead and printer with an increased amount of physical separation between printed and non-printed ink drops; and reduced energy and power requirements capable of rendering high quality images on a wide variety of materials using a wide variety of inks.

SUMMARY OF THE INVENTION

It is an object of the present invention is to increase the amount of physical separation between ink drops traveling along a printed ink drop path and ink drops traveling along a non-printed ink drop path.

It is another object of the present invention is to increase the angle of divergence between ink drops traveling along a printed ink drop path and ink drops traveling along a non-printed ink drop path.

It is another object of the present invention is to reduce energy and power requirements of an ink jet printhead and printer.

It is another object of the present invention to provide a continuous ink jet printhead and printer in which ink drop formation and ink drop deflection occur at high speeds improving performance.

It is another object of the present invention to provide a continuous ink jet printhead and printer having increased ink drop deflection which can be integrated with a print head utilizing the advantages of silicon processing technology offering low cost, high volume methods of manufacture.

According to one feature of the present invention,

According to another feature of the present invention,

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which:

FIG. 2(*b*) shows a top view of a prior art nozzle with an asymmetric heater.

FIG. 2(*c*) shows a schematic cross section of the embodiment shown in FIG. 2(*c*);

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
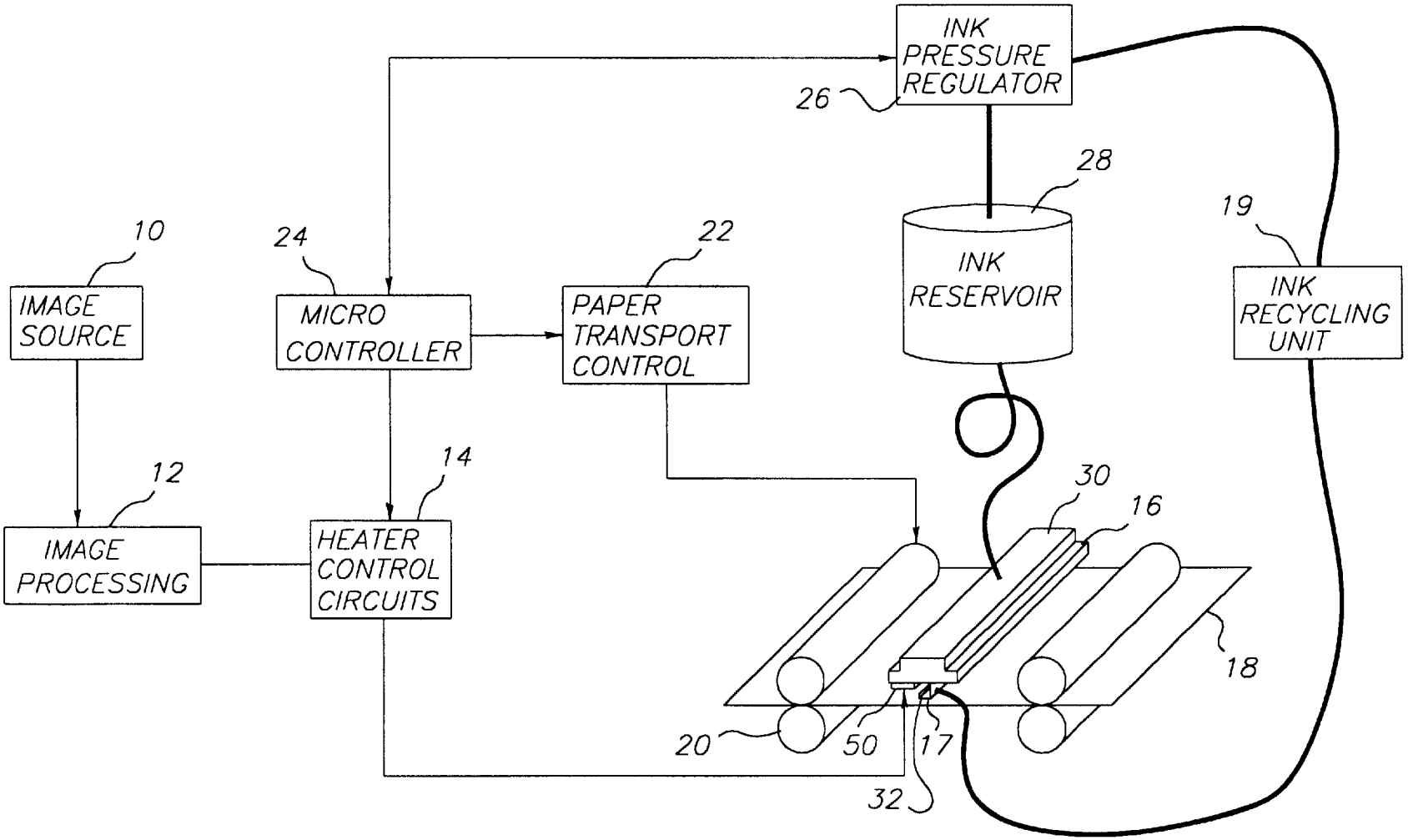
FIG. 1 shows a simplified block schematic diagram of one exemplary printing apparatus made in accordance with the present invention.

Referring to FIG. 1, a continuous ink jet printer system includes an image source 10 such as a scanner or computer which provides raster image data, outline image data in the form of a page description language, or other forms of digital image data. This image data is converted to half-toned bitmap image data by an image processing unit 12 which also stores the image data in memory. A plurality of heater control circuits 14 read data from the image memory and apply time-varying electrical pulses to a set of nozzle heaters 50 that are part of a printhead 16. These pulses are applied at an appropriate time, and to the appropriate nozzle, so that drops formed from a continuous ink jet stream will form spots on a recording medium 18 in the appropriate position designated by the data in the image memory.

Recording medium 18 is moved relative to printhead 16 by a recording medium transport system 20, which is electronically controlled by a recording medium transport control system 22, and which in turn is controlled by a micro-controller 24. The recording medium transport system shown in FIG. 1 is a schematic only, and many different mechanical configurations are possible. For example, a transfer roller could be used as recording medium transport system 20 to facilitate transfer of the ink drops to recording medium 18. Such transfer roller technology is well known in the art. In the case of page width printheads, it is most convenient to move recording medium 18 past a stationary printhead. However, in the case of scanning print systems, it is usually most convenient to move the printhead along one axis (the sub-scanning direction) and the recording medium along an orthogonal axis (the main scanning direction) in a relative raster motion.

Ink is contained in an ink reservoir 28 under pressure. In the non-printing state, continuous ink jet drop streams are unable to reach recording medium 18 due to an ink gutter 17 that blocks the stream and which may allow a portion of the ink to be recycled by an ink recycling unit 19. The ink recycling unit reconditions the ink and feeds it back to reservoir 28. Such ink recycling units are well known in the art. The ink pressure suitable for optimal operation will depend on a number of factors, including geometry and thermal properties of the nozzles and thermal properties of the ink. A constant ink pressure can be achieved by applying pressure to ink reservoir 28 under the control of ink pressure regulator 26.

The ink is distributed to the back surface of printhead 16 by an ink channel device 30. The ink preferably flows through slots and/or holes etched through a silicon substrate of printhead 16 to its front surface, where a plurality of nozzles and heaters are situated. With printhead 16 fabricated from silicon, it is possible to integrate heater control circuits 14 with the printhead. An ink drop deflection amplifier system 32, described in more detail below, is positioned proximate printhead 16.

Figure 2A:
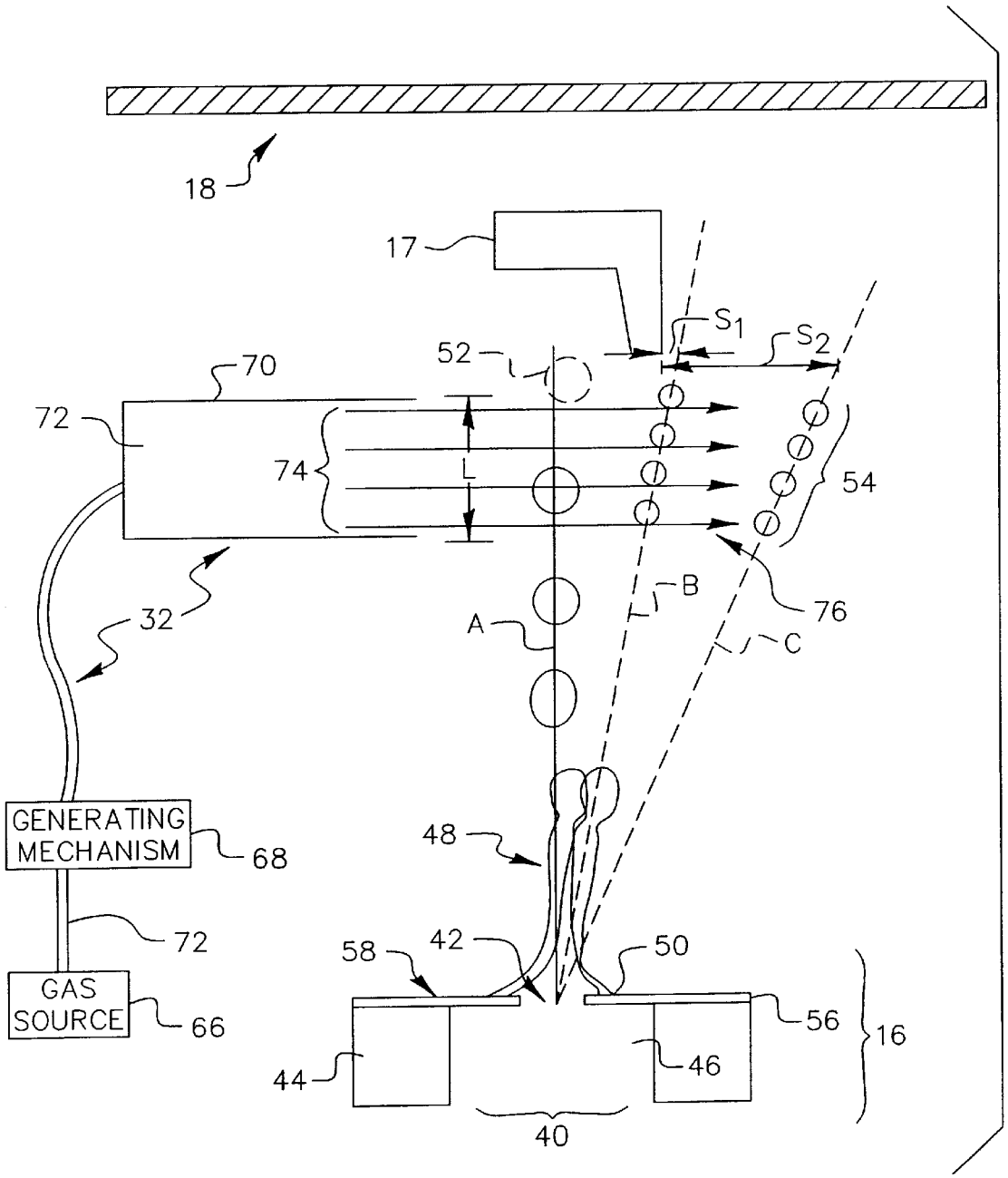
FIG. 2(*a*) shows a schematic cross section of a preferred embodiment of the present invention.
Figure 2B:
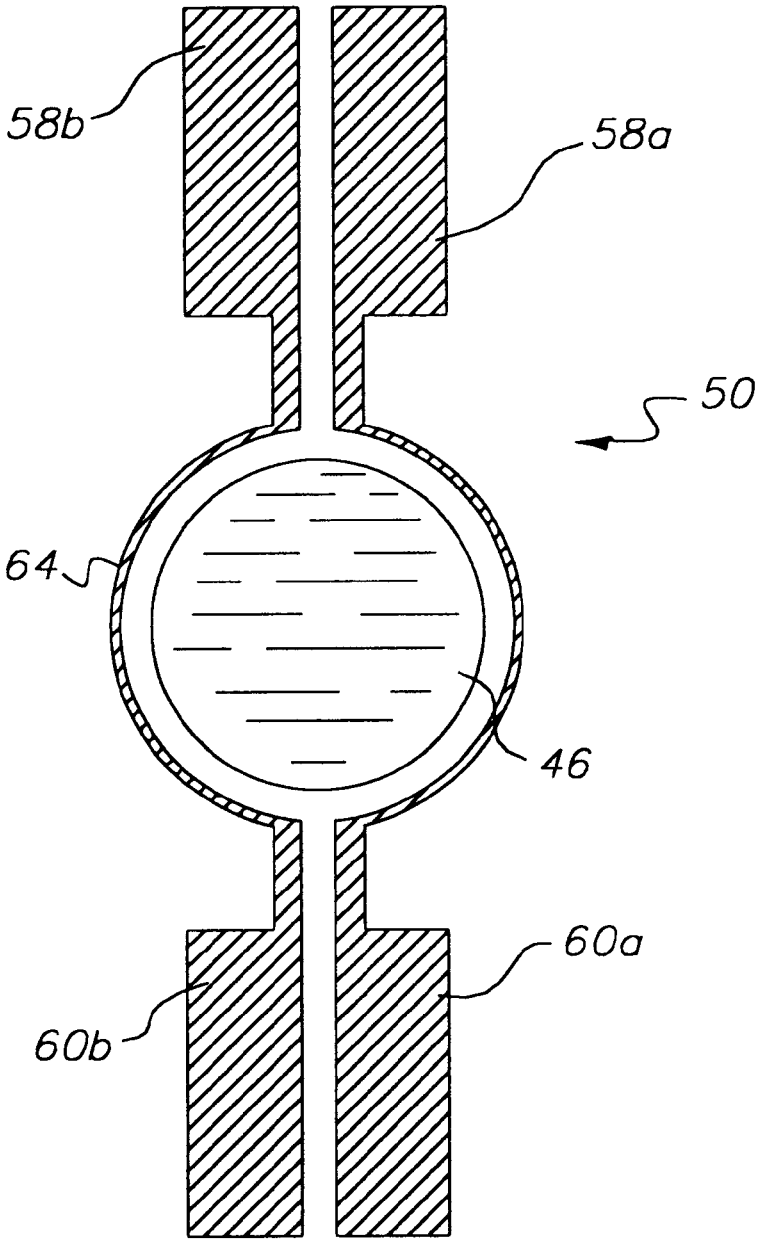
FIG. 2B (PRIOR ART)
Figure 2C:
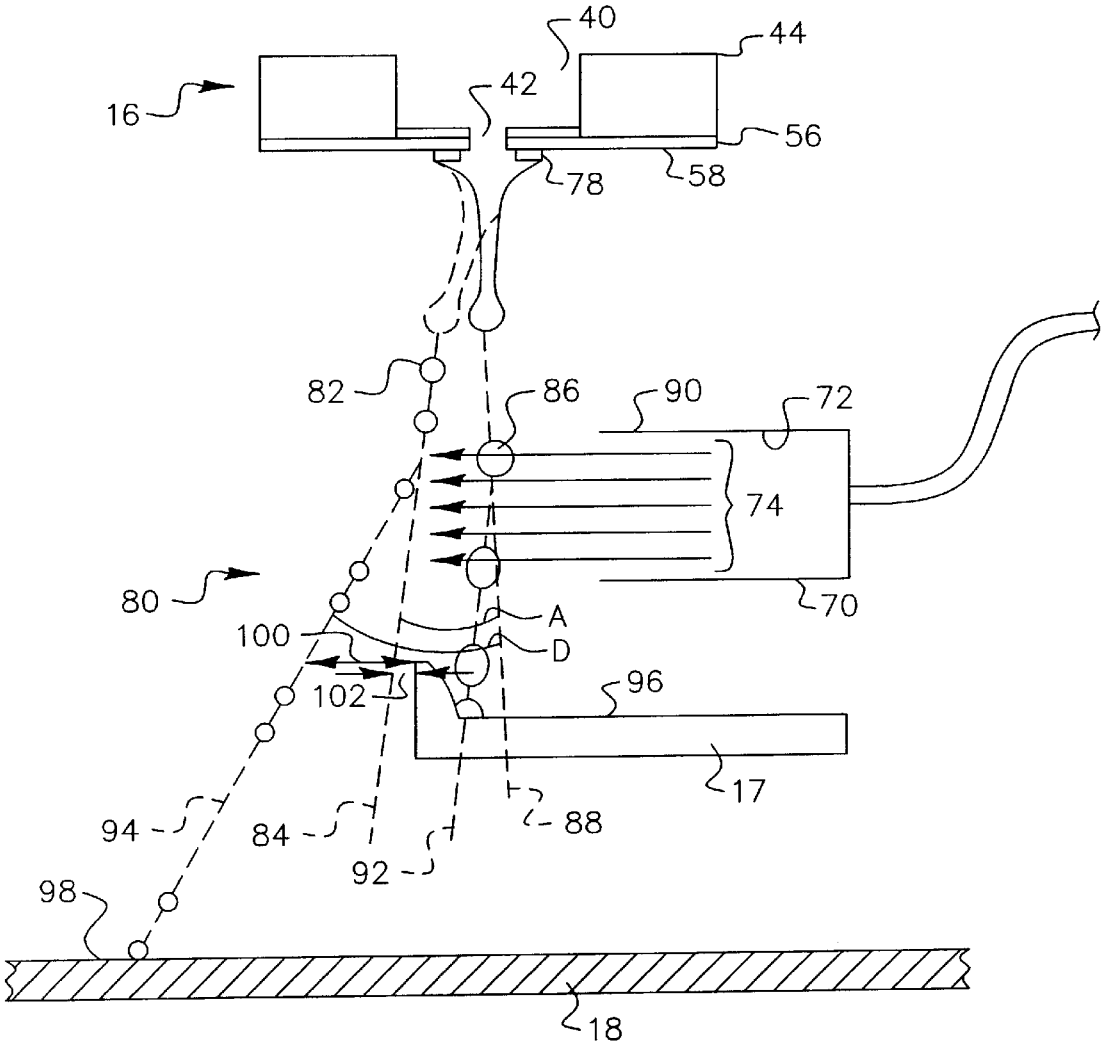

FIG. 2(*a*) is a cross-sectional view of one nozzle tip of an array of such tips that form continuous ink jet printhead 16 of FIG. 1 according to a preferred embodiment of the present invention. An ink delivery channel 40, along with a plurality of nozzle bores 42 are etched in a substrate 44, which is silicon in this example. Delivery channel 40 and nozzle bores 42 may be formed by plasma etching of the silicon to form the nozzle bores. Ink 46 in delivery channel 40 is pressurized above atmospheric pressure, and forms a stream filament 48. At a distance above nozzle bore 42, stream filament 48 breaks into a plurality of sized drops 52, 54 due to heat supplied by heater 50. The volume of each ink drop (52 and 54) being determined by the frequency of activation of heater 50. If the applied heat is of low enough magnitude the drops will follow path A. The heater 50 may be made of polysilicon doped at a level of about thirty ohms/square, although other resistive heater material could be used. Heater 50 is separated from substrate 44 by thermal and electrical insulating layers 56 to minimize heat loss to the substrate. The nozzle bore may be etched allowing the nozzle exit orifice to be defined by insulating layers 56.

The layers in contact with the ink can be passivated with a thin film layer 58 for protection. The printhead surface can be coated with an additional layer to prevent accidental spread of the ink across the front of the printhead. Such a layer may have hydrophobic properties. Although a process is outlined that uses known silicon based processing techniques, it is specifically contemplated and, therefore within the scope of this disclosure, that printhead 16 may be formed from any materials using any fabrication techniques conventionally known in the art.

Referring to FIG. 2(*b*), heater 50 has two sections, each covering approximately one-half of the nozzle perimeter. Power connections 58*a*, 58*b* and ground connections 60*a*, 60*b* from heater control circuits 14 to heater annulus 64 are also shown. Stream filament 48 may be deflected from path A to path B by an asymmetric application of heat by supplying electrical current to one, but not both, of the heater sections. This technology is described in U.S. Pat. No. 6,079,821, issued to Chwalek et al. on Jun. 27, 2000. A plurality of such nozzles may be formed in the same silicon substrate to form a printhead array increasing overall productivity of such a printhead.

Again referring to FIG. 2(*a*) ink drop deflection amplifier system 32 includes a gas source 66 having a force generating mechanism 68 and a housing 70 defining a delivery channel 72. Delivery channel 72 provides a force 74. Force 74 has dimensions substantially similar to that of delivery channel 72. For example, a rectangular shaped delivery channel 72 delivers a force 74 having a substantially rectangular shape. Force 74 is preferably laminar, traveling along an original path (also shown generally at 76). Force 74 eventually loses its coherence and diverges from the original path. In this context, the term "coherence" is used to describe force 74 as force 74 begins to spread out or diverge from its original path. Force 74 interacts with ink drops 52, 54 as ink drops 52, 54 travel along paths A and B. Typically, interaction occurs prior to force 74 losing its coherence.

Referring to FIG. 2(*c*), using a primary selection device 78, for example, heater 50 operating as described above, etc., print head 16 is operable to provide a stream of ink drops 80 traveling along a plurality of diverging ink drop paths. Selected ink drops 82 travel along a selected or first ink drop path 84 while non-selected ink drops 86 travel along a non-selected or second ink drop path 88. An end 90 of delivery channel 72 is positioned proximate paths 84, 88. Selected ink drops 82 and non-selected ink drops 86 interact with force 74. As a result, non-selected ink drops 86 and selected ink drops 82 are caused to alter original courses and travel along a resulting non-selected ink drop path 92 and a resulting selected ink drop path 94, respectfully. Non-selected ink drops 86 travel along resulting non-selected ink drop path 92 until they strike a surface 96 of catcher 17. Non-selected ink drops 86 are then removed from catcher 17 and transported to ink recycling unit 19. Selected ink drops 82 are allowed to continue traveling along resulting selected ink drop path 94 until they strike a surface 98 of recording medium 18.

In a preferred embodiment, selected ink drops 82 are shown as being allowed to strike recording medium 18 while non-selected ink drops 86 are shown as ultimately striking catcher 17. However, it is specifically contemplated and, therefore within the scope of this disclosure, that selected ink drops 82 can ultimately strike catcher 17 while non-selected ink drops 86 are allowed to strike recording medium 18. Additionally, selected ink drops 82 can be either large volume drops 52 or small volume drops 54 (described below) with non-selected ink drops 86 being the other of large volume drops 52 or small volume drops 54 (described below).

Again, referring to FIG. 2(*c*), spacing distance 100 between selected ink drops 82 and gutter 17 is increased after selected ink drops 82 interact with force 74 (as compared to spacing distance 102). Additionally, a resulting ink drop divergence angle (shown as angle D) between selected ink path 94 and non-selected ink drop path 88 is also increased (as compared to angle A, paths 84 and 88). Selected ink drops 82 are now less likely to inadvertently strike catcher 17 resulting in a reduction of ink build up on catcher 17. As ink build up is reduced, print head maintenance and ink cleaning are reduced. Increased resulting ink drop divergence angle D allows the distance selected ink drops 82 must travel before striking recording medium 18 to be reduced because large spatial distances are no longer required to provide sufficient space for selected ink drops 82 to deflect and clear printhead 16 prior to striking recording medium 18. As such, ink drop placement accuracy is improved.

Ink drop deflection amplifier system 32 is of simple construction as it does not require charging tunnels or deflection plates. As such, ink drop deflection amplifier 32 does not require large spatial distances in order to accommodate these components. This also helps to reduce the distance selected ink drops 82 must travel before being allowed to strike recording medium 18 resulting in improved drop placement accuracy.

Ink drop deflection amplifier system 32 can be of any type and can include any number of appropriate plenums, conduits, blowers, fans, etc. Additionally, ink drop deflection system 32 can include a positive pressure source, a negative pressure source, or both, and can include any elements for creating a pressure gradient or gas flow. Also, Housing 70 can be any appropriate shape.

In a preferred embodiment, force 74 can be a gas flow originating from gas source 66. Gas source 66 can be air, nitrogen, etc. Force generating mechanism 68 can be any appropriate mechanism, including a gas pressure generator, any service for moving air, a fan, a turbine, a blower, electrostatic air moving device, etc. Gas source 66 and force generating mechanism 68 can craft gas flow in any appropriate direction and can produce a positive or negative pressure. However, it is specifically contemplated that force 74 can include other types of forces, such as electrically charged ink drops being attracted to oppositely charged plates or repelled by similarly charged plates, etc.

Again referring to FIG. 2(*a*), an operating example is described. During printing, heater 50 is selectively activated creating the stream of ink having a plurality of ink drops having a plurality of volumes and drop deflection amplifier system is operational. After formation, large volume drops 52 also have a greater mass and more momentum than small volume drops 54. As force 74 interacts with the stream of ink drops, the individual ink drops separate depending on each drops volume and mass. The smaller volume droplets will follow path C in FIG. 2(*a*) after interacting with force 74, thus increasing the total amount of physical separation between printed (path C) and non-printed ink drops (path A) and gutter 17. Note that the asymmetric heating deflection path B involves movement of the stream filament 48 while the gas force 74 interacts with only the drops 54 themselves. In addition, the gas force provided by drop deflector 32 will also act on the larger volume drops 52. Accordingly, the gas flow rate in drop deflector 32 as well as the energy supplied to the heater 50 can be adjusted to sufficiently differentiate the small drop path C from the large drop path A, permitting small volume drops 54 to strike print media 18 while large volume drops 52 are deflected as they travel downward and strike ink gutter 17. Due to the increased in separation between the drops in path C with those of path B, the distance or margin between the drop paths and the edge of the gutter 17 has increased from $S_1$ to $S_2$.

This increased margin makes for more robust operation as it provides for greater tolerance in the variation of drop trajectories. Droplet trajectory variations can occur, for instance, due to fabrication non-uniformity from nozzle to nozzle or due to dirt, debris, deposits, or the like that may form in or around the nozzle bore. In addition, the larger the distance $S_2$, the closer the ink gutter 17 may be placed closer to printhead 16 and hence printhead 16 can be placed closer to the recording medium 18 resulting in lower drop placement errors, which will result in higher image quality. Also, for a particular ink gutter to printhead distance, larger distance $S_2$ results in larger deflected drop to ink gutter spacing which would allow a larger ink gutter to printhead alignment tolerance. In addition, the increased separation afforded by the drop deflector 32 allows a reduced amount of energy supplied to the heater 50 resulting in lower temperatures and higher reliability. In an alternate printing scheme, ink gutter 17 may be placed to block smaller drops 54 so that larger drops 52 will be allowed to reach recording medium 18.

The amount of separation between the large volume drops 52 and the small volume drops 54 will not only depend on their relative size but also the velocity, density, and viscosity of the gas coming from drop deflector 32; the velocity and density of the large volume drops 52 and small volume drops 54; and the interaction distance (shown as L in FIG. 2(*a*)) over which the large volume drops 52 and the small volume drops 54 interact with the gas flowing from drop deflector 32 with force 47. Gases, including air, nitrogen, etc., having different densities and viscosities can also be used with similar results.

Large volume drops 52 and small volume drops 54 can be of any appropriate relative size. However, the drop size is primarily determined by ink flow rate through nozzle 42 and the frequency at which heater 50 is cycled. The flow rate is primarily determined by the geometric properties of nozzle 42 such as nozzle diameter and length, pressure applied to the ink, and the fluidic properties of the ink such as ink viscosity, density, and surface tension. As such, typical ink drop sizes may range from, but are not limited to, 1 to 10,000 picoliters.

Although a wide range of drop sizes are possible, at typical ink flow rates, for a 10 micron diameter nozzle, large volume drops 52 can be formed by cycling heaters at a frequency of about 50 kHz producing drops of about 20 picoliter in volume and small volume drops 54 can be formed by cycling heaters at a frequency of about 200 kHz producing drops that are about 5 picoliter in volume. These drops typically travel at an initial velocity of 10 m/s. Even with the above drop velocity and sizes, a wide range of separation between large volume and small volume drops is possible depending on the physical properties of the gas used, the velocity of the gas and the interaction distance L. For example, when using air as the gas, typical air velocities may range from, but are not limited to 100 to 1000 cm/s while interaction distances L may range from, but are not limited to, 0.1 to 10 mm. In addition, both the nozzle geometry and the fluid properties will affect the asymmetric heating deflection (path B) as discussed in U.S. Pat. No. 6,079,821. It is recognized that minor experimentation may be necessary to achieve the optimal conditions for a given nozzle geometry, ink, and gas properties.

Figure 3A:
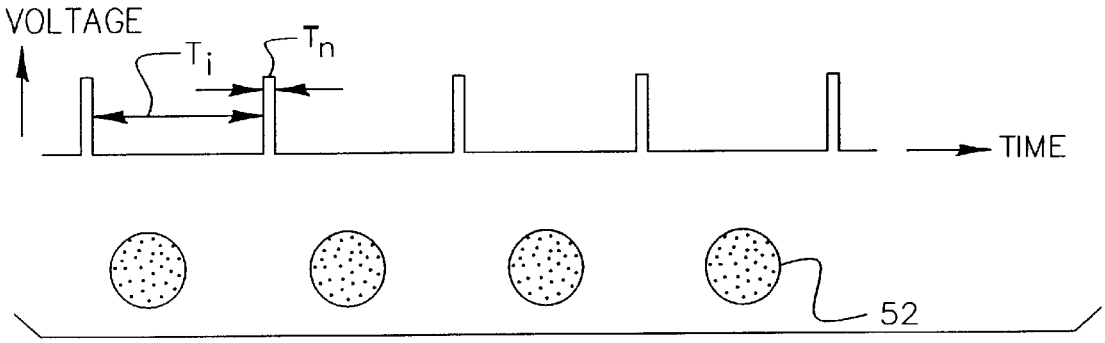
FIGS. 3(*a*)–(*c*) illustrate example electrical pulse trains applied to the heater and the resulting ink drop formation made in accordance with the present invention.
Figure 3B:
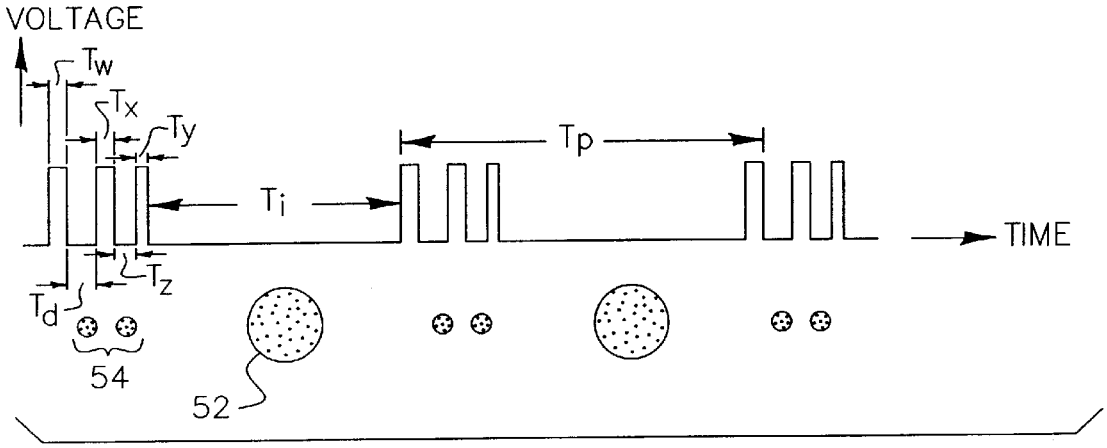
Figure 3C:
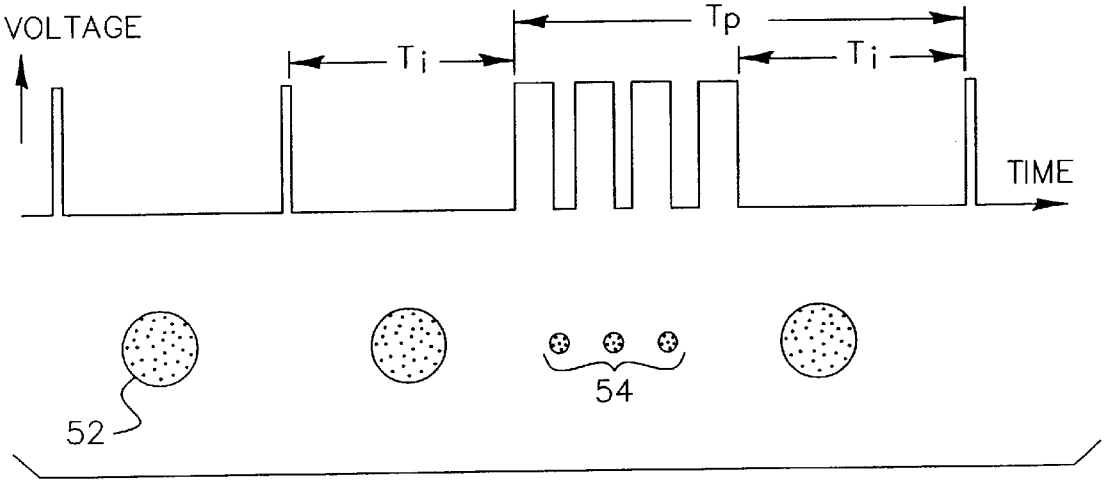

Referring to FIG. 3(*a*), an example of the electrical activation waveform for the non-print or idle state provided by heater control circuits 14 to heater 50 is shown generally as curve (i). The individual ink drops 52 resulting from the jetting of ink from nozzle 42, in combination with this heater actuation, are shown schematically as (ii). Enough energy is provided to heater 50 such that individual drops 52 are formed yet not enough energy is provided to cause substantial deviation of the drops from path A due to asymmetric heating deflection. The amount of energy delivered to heater 50 can be controlled by the applied voltage and the pulse time shown by $T_n$. The low frequency of activation of heater 50 shown by time delay $T_i$, results in large volume drops 52. This large drop volume is always created through the activation of heater 50 with electrical pulse time $T_n$, typically from 0.1 to 10 microseconds in duration, and more preferentially 0.1 to 1.0 microseconds. The delay time $T_i$ may range from, but is not limited to, 10 to 10,000 microseconds.

Referring to FIG. 3(*b*), an example of the electrical activation waveform for the print state provided by heater control circuits 14 to heater 50 is shown generally as curve (ii). The individual ink drops 52 and 54 resulting from the jetting of ink from nozzle 42, in combination with this heater actuation, are shown schematically as (iii). Note that FIGS. 3(*a*) and 3(*b*) are not on the same scale. In the printing state enough energy is provided to heater 50 such that individual drops 54 are formed and deflected along path B due to asymmetric heating deflection. As in the non-print state, the amount of energy delivered to heater 50 can be controlled by the applied voltage and the pulse time. More energy is required in the print state necessitating that either the pulse time of the print state is longer or the applied voltage is higher or both. The high frequency of activation of heater 50 in the print results in small volume drops 54 in FIGS. 2(*a*), 2(*c*), and 3(*b*).

In a preferred implementation, which allows for the printing of multiple drops per image pixel, the time $T_p$ (see FIG. 3(*b*)) associated with the printing of an image pixel consists of time sub-intervals $T_d$ and $T_z$ reserved for the creation of small printing drops plus time for creating one larger non-printing drop $T_i$. In FIG. 3(*b*) only time for the creation of two small printing drops is shown for simplicity of illustration, however, it must be understood that the reservation of more time for a larger count of printing drops is clearly within the scope of this invention. In accordance with image data wherein at least one printing drop is required heater 50 is activated with an electrical pulse $T_w$ and after delay time $T_d$, with an electrical pulse $T_x$. For cases where the image data requires that still another printing drop be created, heater 50 is again activated after delay $T_z$, with a pulse $T_y$. Note that heater activation electrical pulse times $T_w$, $T_x$, and $T_y$ are substantially similar, as are delay times $T_d$ and $T_z$ but necessarily equal. Delay times $T_d$ and $T_z$ are typically 1 to 100 microseconds, and more preferentially, from 3 to 10 microseconds. As stated previously, either voltage amplitudes or pulse times of pulses $T_w$, $T_x$, and $T_y$ are greater than the voltage amplitude or pulse time of non-print pulse $T_n$. Pulse times for $T_w$, $T_x$, and $T_y$ may usefully range from, but are not limited to, 1 to 10 microseconds. Delay time $T_i$ is the remaining time after the maximum number of printing drops have been formed and the start of the electrical pulse time $T_w$, concomitant with the beginning of the next image pixel. Delay time $T_i$ is chosen to be significantly larger than delay times $T_d$ or $T_z$, so that the volume ratio of large non-printing-drops 52 to small printing-drops 54 is preferentially a factor of 4 or greater. This is illustrated in FIG. 3(*c*) where an example of the electrical activation waveform for two idle or non-print periods followed by the issuance of three drops and then an idle period provided by heater control circuits 14 to heater 50 are shown schematically as (v). As in FIGS. 3(*a*) and 3(*b*), The individual ink drops 52 and 54 resulting from the jetting of ink from nozzle 42, in combination with this heater actuation, are shown schematically as (vi). In the example of FIG. 3(*c*), the delay time $T_i$ is kept constant producing large non-printing-drops 52 of equal volume. An alternative, where the pixel time $T_p$ is held constant resulting in varying times $T_i$, depending on the number of small printing-drops 54 desired, and hence varying large non-printing-drops 52 volumes is also within the scope of this invention. It is still desired, in this case, to have the smallest volume of the resulting plurality of large non-printing-drops 52 to be preferentially a factor of 4 or greater than the volume of the small printing-drops 54.

Heater 50 activation may be controlled independently based on the ink color required and ejected through corresponding nozzle 42, movement of printhead 16 relative to a print media 18, and an image to be printed. It is specifically contemplated, and therefore within the scope of this disclosure that the absolute volume of the small drops 54 and the large drops 52 may be adjusted based upon specific printing requirements such as ink and media type or image format and size. As such, reference below to large volume drops 52 and small volume drops 52 is relative in context for example purposes only and should not be interpreted as being limiting in any manner.

Figure 4:
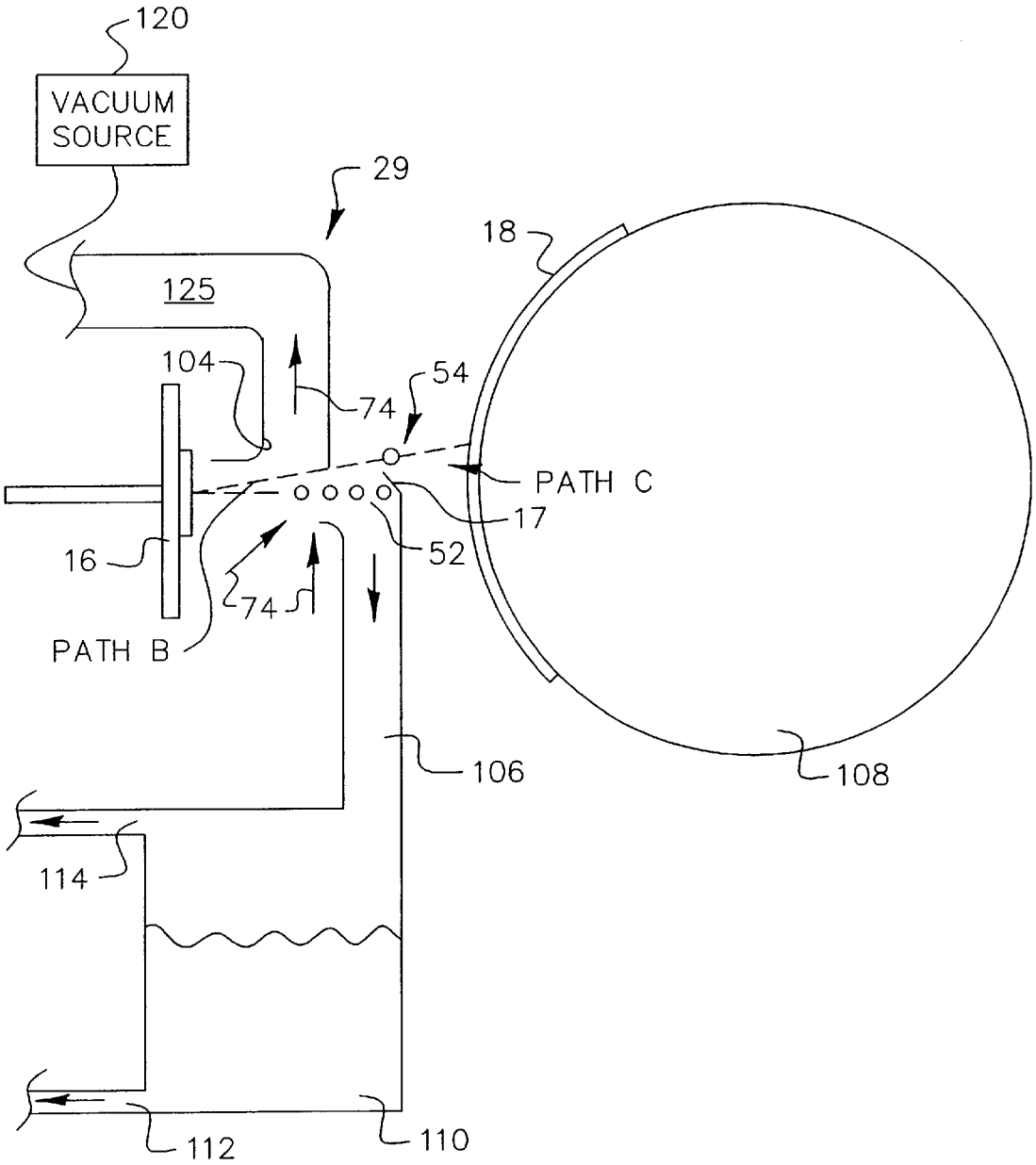
FIG. 4 is schematic view of an apparatus made in accordance with an alternative embodiment of the present invention.

FIG. 4 illustrates one possible implementation of system 32. In this embodiment, force 74 originates from a negative pressure created by a vacuum source 120, etc. and communicated through deflector plenum 125. Printhead 16 is fed by ink provided by ink reservoir 28 (shown in FIG. 1) and produces a stream of drops in a manner outlined previously. Typically, force 74 is positioned at an angle with respect to the stream of ink drops operable to selectively deflect ink drops depending on ink drop volume. Ink drops having a smaller volume are deflected more than ink drops having a larger volume. An end 104 of the system 32 is positioned proximate path B. As stated previously, path B is the path that small ink drops 54 take upon asymmetric heating deflection. Force 74 increases the overall separation whereby small ink drops 54 follow path C. An ink recovery conduit 106 contains a ink guttering structure 17 whose purpose is to intercept the path of large drops 52, while allowing small ink drops to continue on to the recording media 18. In this embodiment recording media 18 is carried by print drum 108. Ink recovery conduit 106 communicates with ink recovery reservoir 110 to facilitate recovery of non-printed ink drops by an ink return line 112 for subsequent reuse. A vacuum conduit 114, coupled to a negative pressure source can communicate with ink recovery reservoir 110 to create a negative pressure in ink recovery conduit 106 improving ink drop separation and ink drop removal. The gas flow rate in ink recovery conduit 106, however, is chosen so as to not significantly perturb small drop path C. The ink recovery system discussed above may be considered part of the ink recycling unit 19 shown in FIG. 1.

Although an array of streams is not required in the practice of this invention, a device comprising an array of streams may be desirable to increase printing rates. In this case, deflection and modulation of individual streams may be accomplished as described for a single stream in a simple and physically compact manner, because such deflection relies only on application of a small potential, which is easily provided by conventional integrated circuit technology, for example CMOS technology.

Printhead 16 can be of any size and type. For example, printhead 16 can be a pagewidth printhead, a scanning printhead, etc. Components of printhead 16 can have various relative dimensions. Heater 50 can be formed and patterned through vapor deposition and lithography techniques, etc. Heater 50 can include heating elements of any shape and type, such as resistive heaters, radiation heaters, convection heaters, chemical reaction heaters (endothermic or exothermic), etc. The invention can be controlled in any appropriate manner. As such, controller 24 can be of any type, including a microprocessor based device having a predetermined program, software, etc.

Print media 18 can be of any type and in any form. For example, the print media can be in the form of a web or a sheet. Additionally, print media 18 can be composed from a wide variety of materials including paper, vinyl, cloth, other large fibrous materials, etc. Any mechanism can be used for moving the printhead relative to the media, such as a conventional raster scan mechanism, etc.

Additionally, it is specifically contemplated that the present invention can be used in any system where ink drops need to be deflected. These systems include continuous systems using deflection plates, electrostatic deflection, piezoelectric actuators, thermal actuators, etc.

The invention has been described in detail with particular reference to preferred embodiments thereof, but it will be understood that variations and modifications can be effected within the spirit and scope of the invention.

What is claimed is:

1. An ink drop deflector mechanism comprising:

a source of ink drops;

a path selection device operable in a first state to direct drops from the source along a first path and in a second state to direct drops from the source along a second path, said first and second paths diverging from said source; and a system which applies force to drops travelling along at least one of said first and second paths, said system including a gas source which generates a gas flow, said gas flow being applied in said direction substantially perpendicular to said first path such that divergence of said first path is increased.

2. The ink drop deflector mechanism according to claim 1, wherein said gas flow is positioned proximate said second path.

3. The ink drop deflector mechanism according to claim 1, wherein said gas flow is substantially laminar.

4. The ink drop deflector mechanism according to claim 3, wherein said substantially laminar gas flow interacts with said at least one of said first and second paths prior to said substantially laminar gas flow losing its coherence.

5. The ink drop deflector mechanism according to claim 1, further comprising:

a catcher, wherein at least a portion of said system is positioned above said catcher.

6. The ink drop deflector mechanism according to claim 1, further comprising:

a controller operable to form ink drops having a plurality of volumes.

7. A method of increasing divergence in ink drops comprising:

providing a source of ink drops;

directing the ink drops to travel in a first state along a first path and in a second state along a second path, the first and second paths diverging from the source; and causing the divergence of at least one path to increase by applying a force in a direction substantially perpendicular to drops travelling along at least one of the first and second paths, wherein applying the force includes generating a gas flow and applying the gas flow to drops travelling along at least one of the first and second paths.

8. The method according to claim 7, wherein generating the gas flow includes generating a substantially laminar gas flow.

9. The method according to claim 7, wherein applying the gas flow includes applying the gas flow to at least one of the first and second paths prior to the gas flow losing its coherence.

10. A method of increasing divergence in ink drops comprising:

providing a source of ink drops;

directing the ink drops to travel in a first state along a first path and in a second state along a second path, the first and second paths diverging from the source; and causing the divergence of at least one path to increase by positioning a gas flow proximate to one of the first and second paths.

11. An ink drop deflector mechanism comprising:

a source of ink drops;

a path selection device operable in a first state to direct ink drops from the source along a first path and in a second state to direct drops from the source along a second path, said first and second paths diverging from said source, said path selection device including a heater operable to produce said ink drops traveling along said first path and said second path; and a system which applies force to drops travelling along at least one of said first and second paths, said system including a gas source which generates a gas flow, said gas flow being applied in a direction substantially perpendicular to said first path such that divergence of said first path is increased.

12. The ink drop deflector mechanism according to claim 11, wherein said gas flow is substantially laminar.

13. The ink drop deflector mechanism according to claim 11, wherein said heater is an asymmetric heater.

14. A method of increasing divergence in ink drops comprising:

providing a source of ink drops;

directing the ink drops to travel in a first state along a first path and in a second state along a second path, the first and second paths diverging from the source; and causing the divergence of at least one path to increase, wherein causing the divergence of at least one path to increase includes applying a gas flow to drops travelling along at least one of the first and second paths.

15. The method according to claim 14, wherein applying the gas flow includes applying a substantially laminar gas flow.

16. The method according to claim 14, wherein causing the divergence of the paths to increase includes applying the gas flow in a direction substantially perpendicular to drops travelling along at least one of the first and second paths.

* * * * *